US006448523B1

(12) United States Patent
Aizawa

(10) Patent No.: US 6,448,523 B1
(45) Date of Patent: Sep. 10, 2002

(54) ROTARY ELECTRICAL COMPONENT WITH TACTILE FEEDBACK

(75) Inventor: Seiji Aizawa, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/547,005

(22) Filed: Apr. 11, 2000

(30) Foreign Application Priority Data

Apr. 12, 1999 (JP) ..... 11-104191

(51) Int. Cl.[7] ..... H01H 19/20
(52) U.S. Cl. ..... 200/564; 200/570
(58) Field of Search ..... 200/28, 564, 565, 200/569, 570, 571

(56) References Cited

U.S. PATENT DOCUMENTS 4,107,634 A * 8/1978 Scaletta et al. ..... 333/81 A
4,117,280 A * 9/1978 Feaster ..... 200/6 B
4,719,324 A 1/1988 Kuratani
5,373,132 A * 12/1994 Achermann et al. ..... 200/310
5,669,489 A * 9/1997 Von Ende ..... 200/570
5,847,335 A * 12/1998 Sugahara et al. ..... 200/4
6,143,994 A * 11/2000 Thivilier ..... 200/11 R
6,175,091 B1 * 1/2001 Nishimura et al. ..... 200/571

FOREIGN PATENT DOCUMENTS

DE 3342609 * 11/1983
JP 52-2224 6/1950

* cited by examiner

*Primary Examiner*—Michael Friedhofer
*Assistant Examiner*—Lisa N Klaus
(74) *Attorney, Agent, or Firm*—Brinks Hofer Gilson & Lione

(57) ABSTRACT

In a tactile-feedback rotary electrical component, a first U-shaped spring is mounted in a recessed holding portion formed in a housing along the axial direction of an operating member. When the operating member is rotated, a protuberance formed on the first U-shaped spring engages with and disengages from recesses formed in the operating member, thereby producing tactile feedback.

15 Claims, 10 Drawing Sheets

ROTARY ELECTRICAL COMPONENT WITH TACTILE FEEDBACK

BACKGROUND OF THE INVENTION

1. Field of the Invention

The present invention relates to a tactile-feedback rotary electrical component that is suitably used in electronic devices such as microwave ovens and acoustic devices.

2. Description of the Related Art

As an example of a conventional tactile-feedback rotary electrical component, a rotary variable resistor will be described below with reference to FIGS. 12 and 13. Referring to FIG. 12, an operating member 52 is rotatably mounted in a cup-shaped metal cover 51.

In the operating member 52, an operating section 53 and a disklike rotating section 54 are integrally formed. The rotating section 54 is held inside the cover 51, and the operating section 53 protrudes from the cover 51.

An insulating substrate 57 with resistors 55 and the conductors 56 is attached to the open end of the cover 51, and a sliding element 58 mounted on the rotating section 54 is in sliding contact with the resistors 55 and the conductors 56.

A metal leaf spring 59 includes a zigzag portion 59*a* bent in a zigzag form, and a semicircular protuberance 59*b* at the end thereof.

The leaf spring 59 is mounted in a hole 54*a* formed in the rotating section 54 so that the protuberance 59*b* engages with and disengages from a recess 51*a* formed in the cover 51.

When the operating section 53 is rotated, the rotating section 54 is also rotated. The sliding element 58 slides on the resistors 55 and the conductors 56 to change the resistance, and the protuberance 59*b* of the leaf spring 59 engages with and disengages from the recess 51*a* of the cover 51 to give tactile feedback in the rotation of the operating section 53.

In the above-described conventional tactile-feedback rotary electrical component, since the leaf spring 59 for obtaining tactile feedback is mounted in the rotating section 54, it must be mounted in the cover 51 while being held in the rotating section 54. This reduces assembly efficiency and increases cost.

Since the hole 54*a* of the rotating section 54 holds the zigzag leaf spring 59 therein, it must be large enough to allow the leaf spring 59 to move in the direction perpendicular to the axial direction. For this reason, the leaf spring 59 is fitted loosely and rattles in the axial direction of the operating section 53, thereby degrading the tactile feedback.

Since the leaf spring 59 has a zigzag shape, workability is decreased and the cost is increased.

Since the zigzag leaf spring 59 is mounted in the hole 54*b* of the rotating section 54, when the rotating section 54 is decreased in thickness and size for the purpose of reducing the size of the rotary electrical component, the leaf spring 59 is also decreased in size. In particular, this makes it difficult to obtain a high torque.

SUMMARY OF THE INVENTION

Accordingly, it is an object of the present invention to provide an inexpensive tactile-feedback rotary electrical component with high assembly efficiency.

In order to overcome the above problems, according to an aspect of the present invention, there is provided a tactile-feedback rotary electrical component including: a housing; an operating section rotatably mounted in the housing; a rotating section held in the housing to be rotated by the operating section; and a first U-shaped spring formed of a leaf spring, wherein the first U-shaped spring is held in a recessed holder section formed in the housing, one of the outer peripheral surface of the rotating section and the first U-shaped spring has a protuberance, the other has a recess, and the protuberance and the recess are engaged and disengaged by the rotation of the rotating section so as to produce tactile feedback.

Preferably, the rotating section has the recess, and the first U-shaped spring has the protuberance.

Preferably, the protuberance is shaped like a rib, and the recess is shaped like a groove.

Preferably, the housing has a cylindrical wall section having an open end portion opened at the rear end, the holder section is formed in the wall section, and the first U-shaped spring is held in the holder section so as to be placed along the axial direction of the operating section.

Preferably, two first U-shaped springs are mounted in the holder section, and the sliding paths of the protuberances of the two first U-shaped springs with respect to the rotating section are different from each other.

Preferably, the recessed holder section includes an open portion facing the open portion of the wall section at one end in the axial direction of the operating section, and an inner portion. Preferably, one of the first U-shaped springs is placed so that a free end portion thereof is disposed on the side of the open portion of the holder section and so that a connecting portion thereof is disposed in the inner portion, and the other U-shaped spring is placed so that a connecting portion thereof is disposed on the side of the open portion of the housing and so that a free end portion thereof is disposed in the inner portion. Preferably, the sliding paths of the protuberances of the two first U-shaped springs with respect to the rotating section are different from each other.

The tactile-feedback rotary electrical component may further include a second U-shaped spring formed of a leaf spring for elastically pressing the outer peripheral surface of the rotating section.

Preferably, the wall section of the housing has a polygonal outer wall, and the holder section is formed on the inner wall of the wall section facing the corner of the outer wall.

Preferably, at least the first U-shaped spring is held in one of the plural holder sections, the first or second U-shaped spring is held in the other holder section, and the rotating section is elastically pressed toward the rotation center by the plural U-shaped springs.

Further objects, features, and advantages of the present invention will become apparent from the following description of the preferred embodiments with reference to the attached drawings.

DESCRIPTION OF THE PREFERRED EMBODIMENTS

Figure 1:
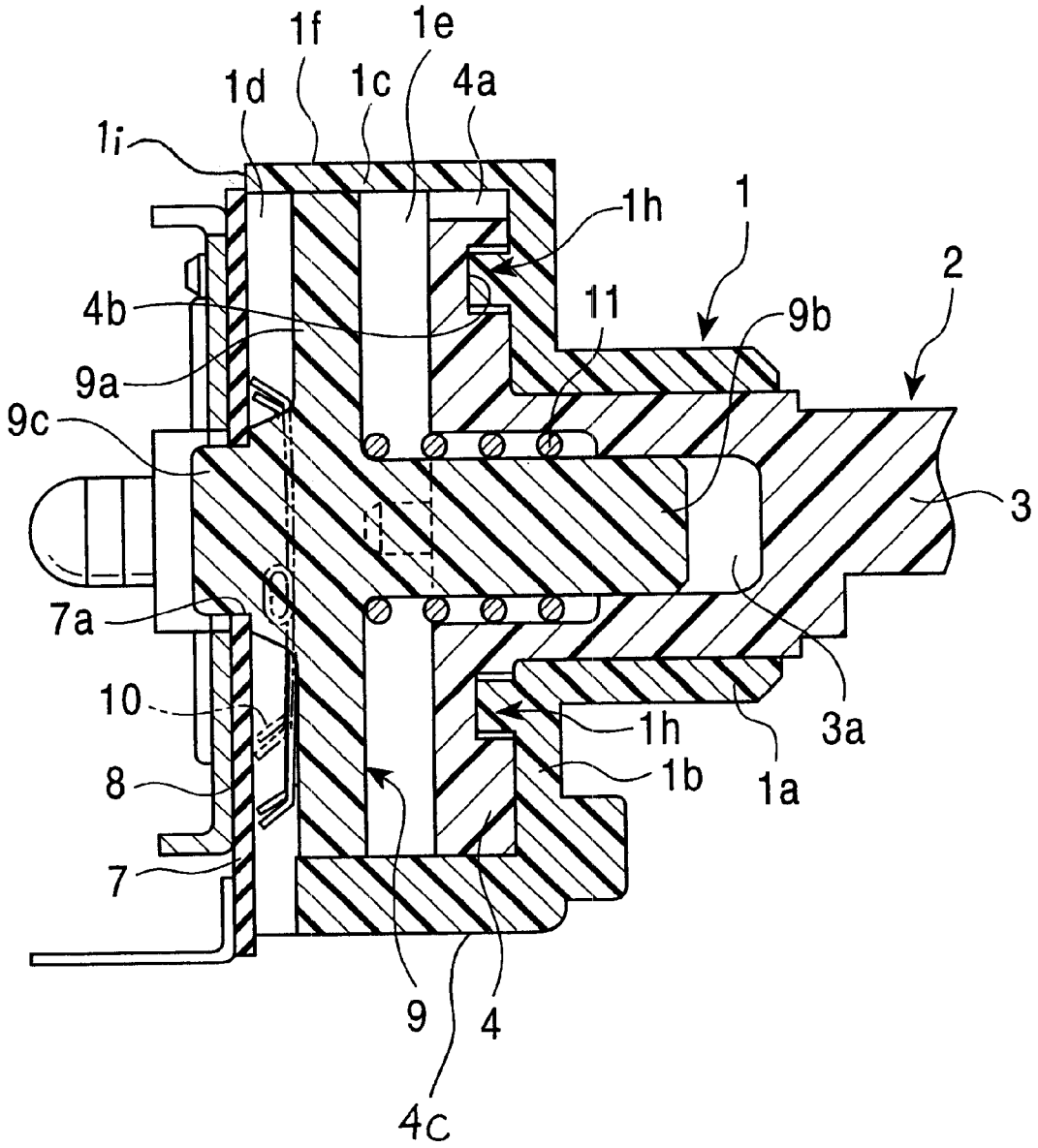
FIG. 1 is a sectional view showing the principal part of a tactile-feedback rotary electrical component according to a first embodiment of the present invention.
Figure 2:
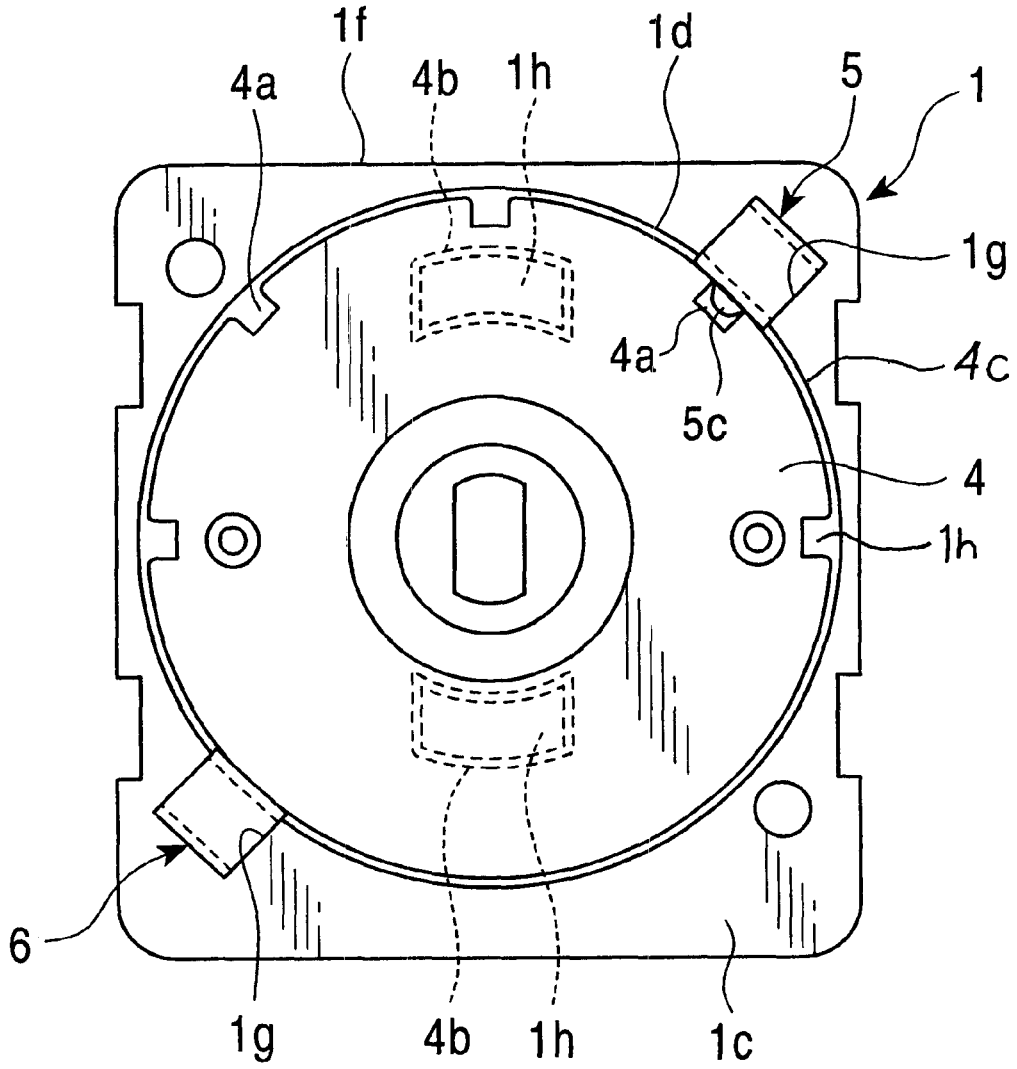
FIG. 2 is a rear view of the tactile-feedback rotary electrical component in which an operating member is mounted in a housing.
Figure 3:
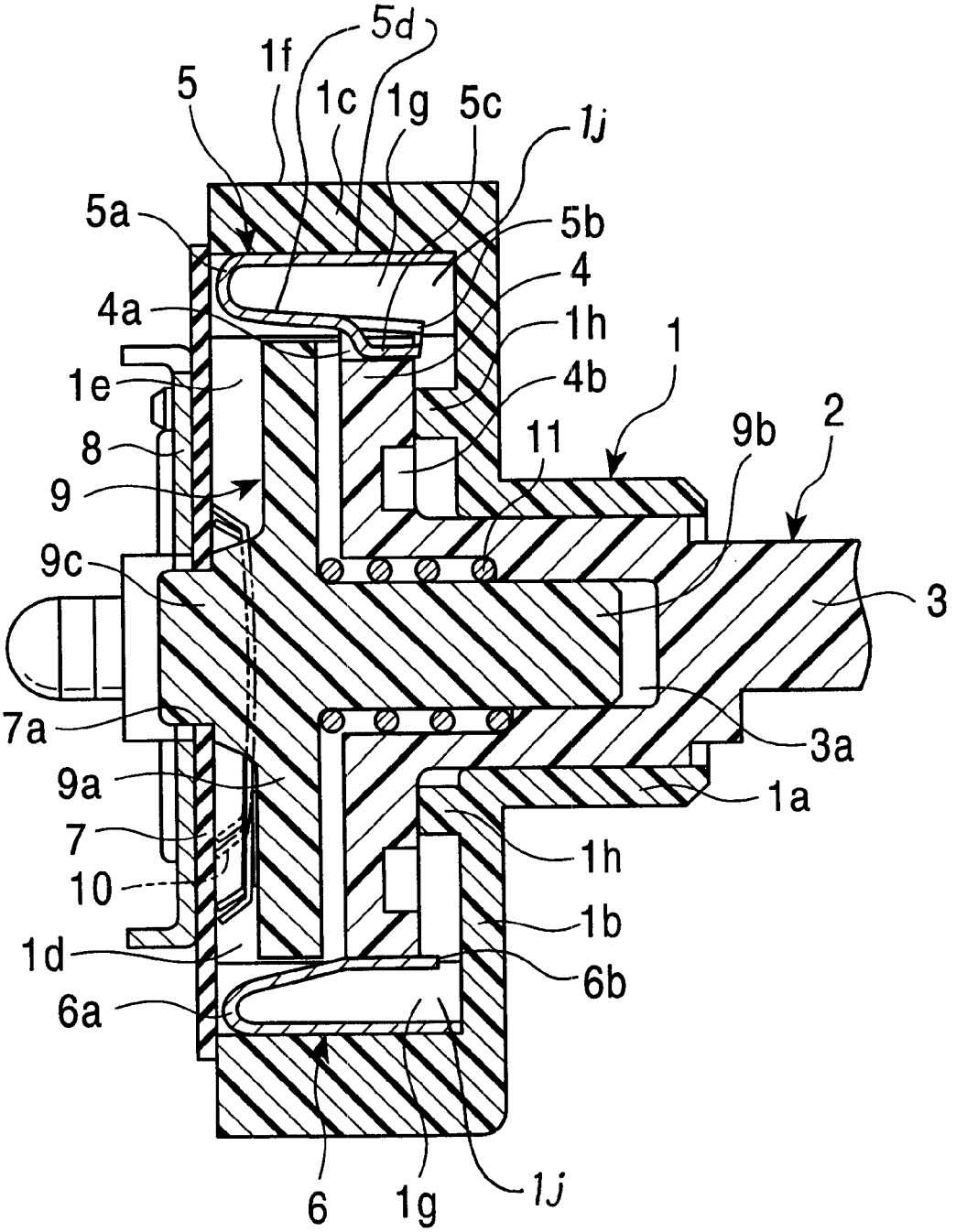
FIG. 3 is a sectional view showing the mounting state of U-shaped springs in the principal part of the tactile-feedback rotary electrical component.
Figure 4:
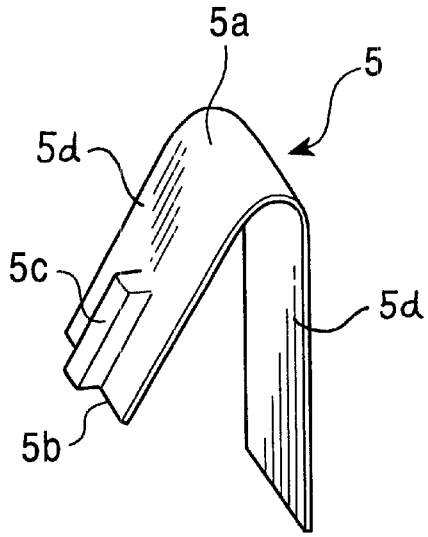
FIG. 4 is a perspective view of a first U-shaped spring in the tactile-feedback rotary electrical component.
Figure 5:
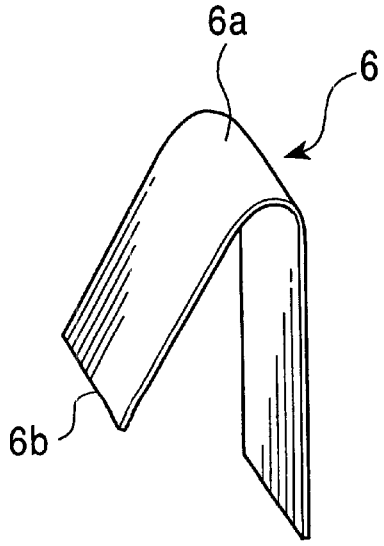
FIG. 5 is a perspective view of a second U-shaped spring in the tactile-feedback rotary electrical component.
Figure 6:
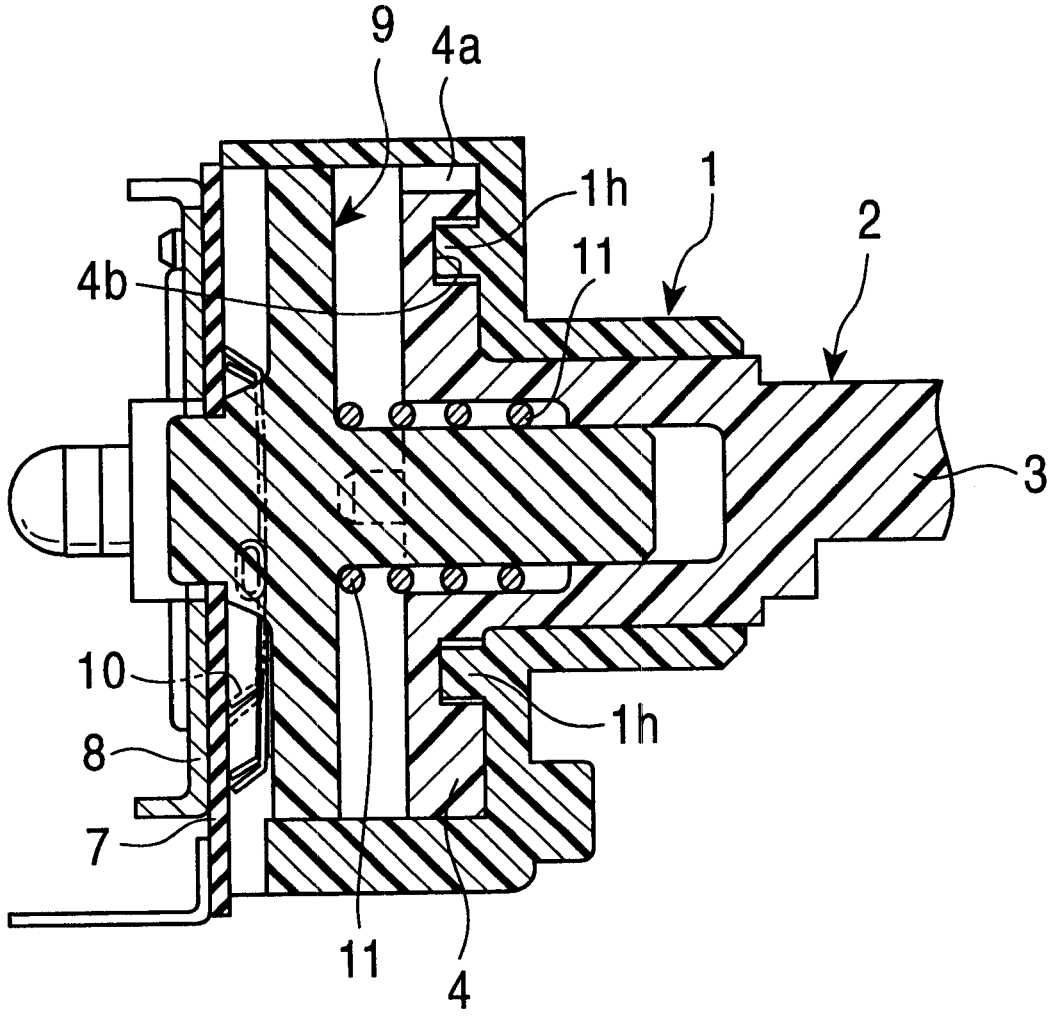
FIG. 6 is an explanatory view showing the operation of the tactile-feedback rotary electrical component of the first embodiment.
Figure 7:
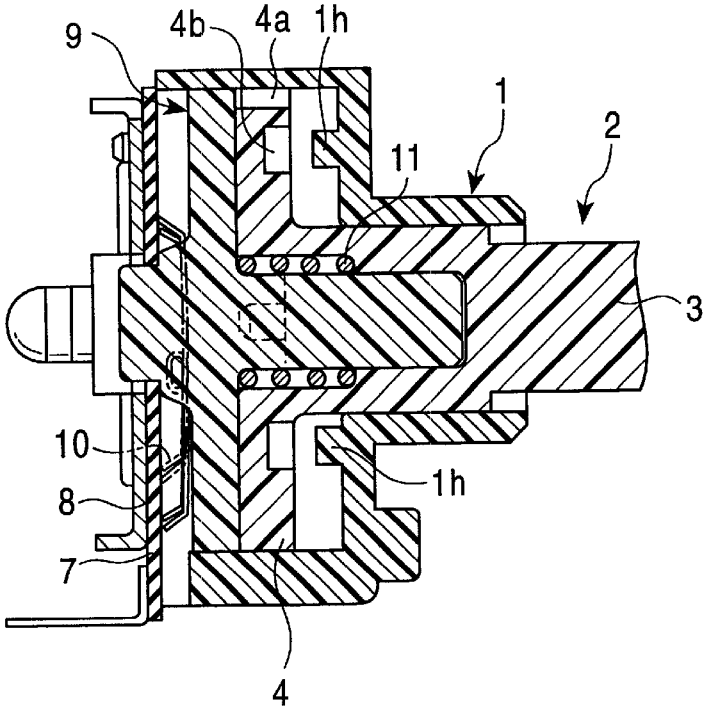
FIG. 7 is an explanatory view showing the operation of the tactile-feedback rotary electrical component of the first embodiment.
Figure 8:
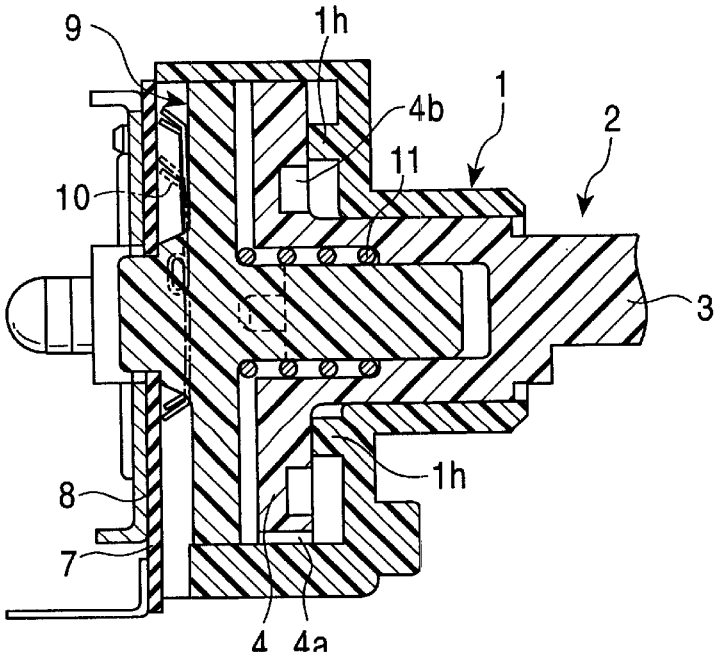
FIG. 8 is an explanatory view showing the operation of the tactile-feedback rotary electrical component of the first embodiment.

As an example of a tactile-feedback rotary electrical component according to a first embodiment, a rotary variable resistor will now be described with reference to FIGS. 1 to 8. FIG. 1 is a sectional view showing the principal part of the rotary variable resistor, FIG. 2 is a rear view of the rotary variable resistor in which an operating member is mounted in a housing, FIG. 3 is a sectional view showing the mounting state of U-shaped springs in the principal part of the rotary variable resistor, FIG. 4 is a perspective view of a first U-shaped spring, FIG. 5 is a perspective view of a second U-shaped spring, and FIGS. 6 to 8 are explanatory views showing the operation of the rotary variable resistor.

In the rotary variable resistor, a housing 1, which is die-cast in zinc or is molded of synthetic resin, comprises a bearing section 1*a*, a front side plate 1*b*, and a cylindrical wall section 1*c* formed integrally with the bearing section 1*a* via the front side plate 1*b*.

The wall section 1*c* of the housing 1 includes a holder portion 1*e* formed in the center with an open portion 1*d* at one end 1*i*, a polygonal (quadrangular) outer wall 1*f*, and a plurality of holding recesses 1*g* formed on the inner surface 1*h* of the wall section 1*c* so as to face the corners of the outer wall 1*f*.

The front side plate 1*b* has two engaging protuberances 1*h* formed at different distances from the center in the radial direction so as to protrude in the holder portion 1*e*.

An operating member 2 molded of synthetic resin or the like includes an operating section 3 and a rotating section 4. The operating section 3 has a noncircular hole 3*a* in the center. The rotating section 4 has a plurality of groove-shaped elongated recesses 4*a* on the outer peripheral surface 4*c*, and two engaging recesses 4*b* formed on the flat front surface at different distances from the center in the radial direction.

The operating member 2 is mounted in the housing 1 so as to rotate and move in the axial direction while the operating section 3 is passed through the bearing section 1*a* and the rotating section 4 is held in the holder section 1*e*.

When the operating member 2 is mounted in the housing 1, the recesses 4*a* are in parallel with the axial direction of the operating section 3, and the engaging recesses 4*b* are allowed to engage with and disengage from the engaging protuberances 1*h* of the housing 1.

A first U-shaped spring 5 formed of a leaf spring includes, as shown in FIG. 4, a connecting portion 5*a*, two connecting pieces 5*d*, two free end portions 5*b* connected by the connecting portion 5*a*, and a relatively long rib-shaped protuberance 5*c* formed on one of the free end portions 5*b*.

The first U-shaped spring 5 is held in a holding recess 1*g* parallel to the axial direction of the operating section 3 so that the free end portions 5*b* are disposed in the inner part 1*j* of the holding recess 1*g* and the connecting portion 5*a* is disposed on the side of the open portion 1*d*. The protuberance 5*c* engages with and disengages from the recesses 4*a* of the rotating section 4, thereby producing tactile feedback.

While the rotating section 4 has the recesses 4*a* and the first U-shaped spring 5 has the protuberance 5*c* in this embodiment, the rotating section 4 may have protuberances and the first U-shaped spring 5 may have a recess.

A second U-shaped spring 6 formed of a leaf spring includes, as shown in FIG. 5, a connecting portion 6*a*, and two free end portions 6*b* connected by the connecting portion 6*a*.

The second U-shaped spring 6 is held in a holding recess 1*g* parallel to the axial direction of the operating section 3 so that the free end portions 6*b* are disposed in the inner part 1*j* of the holding recess 1*g* and the connecting portion 6*a* is disposed on the side of the open portion 1*d*. One of the free end portions 6*b* elastically presses the outer peripheral surface 4*c* of the rotating section 4. Thus, the first and second U-shaped springs 5 and 6 elastically press the rotating section 4 toward the rotating center so as to prevent the rotating section 4 from undergoing run-out.

The second U-shaped spring 6 may be replaced with the same U-shaped spring as the above-described first U-shaped spring 5 that provides similar functions.

An insulating substrate 7 has resistors (not shown) and conductors (not shown). The insulating substrate 7 is mounted on the housing 1 by an attachment plate 8 disposed at the rear thereof so as to close the open portion 1*d* of the housing 1.

A rotary member 9 molded of synthetic resin comprises a disklike receiving portion 9*a*, a non-cylindrical shaft portion 8*b* formed on one surface of the receiving portion 9*a*, and a protuberance 9*c* formed on the other surface of the receiving portion 9*a*. A sliding element 10 is mounted on the receiving portion 9*a* of the rotary member 9 so as to be in sliding contact with the resistors and the conductors.

The rotary member 9 is rotatably mounted so that the shaft portion 9*b* is inserted in and is spline-connected to the hole 3*a* of the operating member 2, and so that the protuberance 9*c* is fitted in a hole 7*a* formed in the insulating substrate 7.

A coil spring 11 is also inserted in the hole 3*a* so as to surround the outer periphery of the shaft portion 9*a*, and is stretched between the operating member 2 and the rotary member 9. The spring 11 constantly elastically presses the operating member 2 against the front side plate 1*b*, and urges the rotary member 9 toward the insulating substrate 7.

Thus, the operating member 2 is allowed to move in the axial direction against the spring 11 while it is in spline connection with the rotary member 9.

When the operating member 2 is moved, the rotating section 4 is also moved in the axial direction. In this case, the recess 4*a* of the rotating section 4 and the protuberance 5*c* of the first U-shaped spring 5 do not disengage from each other, and the rotating section 4 can smoothly move in the axial direction since the first U-shaped spring 5 is in parallel with the axial direction.

When the operating member 2 is turned further, the rotary member 9 is also turned, and the sliding element 10 moves in sliding contact with the resistors and the conductors.

Description will be given of the operation of the tactile-feedback rotary electrical component of the first embodiment with reference to FIGS. 6 to 8.

In a non-operation state shown in FIG. 6, the engaging protuberances 1*h* of the housing 1 are fitted in the engaging recesses 4*b* of the operating member 2 to establish engagement therebetween.

In this state, the engaging recesses 4*b* and the engaging protuberances 1*h* are disengaged by pushing the operating member 2 in the axial direction against the spring 11, as shown in FIG. 7. When the operating member 2 is slightly rotated in this state and is then released from pushing, a state shown in FIG. 8 is brought about.

Such a push is given so as to prevent the operating member 2 for a microwave oven and the like from being easily rotated, and to thereby maintain safety.

In the state shown in FIG. 8, the two engaging protuberances 1*h* disposed at different distances from the center are disengaged from the engaging recesses 4*b*, and contact the flat surface of the rotating section 4. When the operating member 2 is rotated in this state, the protuberance 5*c* of the first U-shaped spring 5 engages with and disengages from the recesses 4*a* of the rotating section 4, thereby producing tactile feedback. Moreover, the rotary member 9 spline-connected to the operating member 2 is also rotated, and the sliding element 7 slides on the resistors and the conductors, thereby adjusting the resistance.

When the operating member 2 is rotated in reverse by means of a timer or the like, it is returned to the initial state shown in FIG. 6.

While the operating section 3 and the rotary member 9 are spline-connected between the shaft portion 9*b* and the hole 3*a* in this embodiment, the rotating section 4 may have a plurality of protuberances on its surface facing the rotary member 9, and the rotary member 9 may have through holes for passing the protuberances therethrough. In this case, the degree of connection in the rotating direction is increased.

Figure 9:
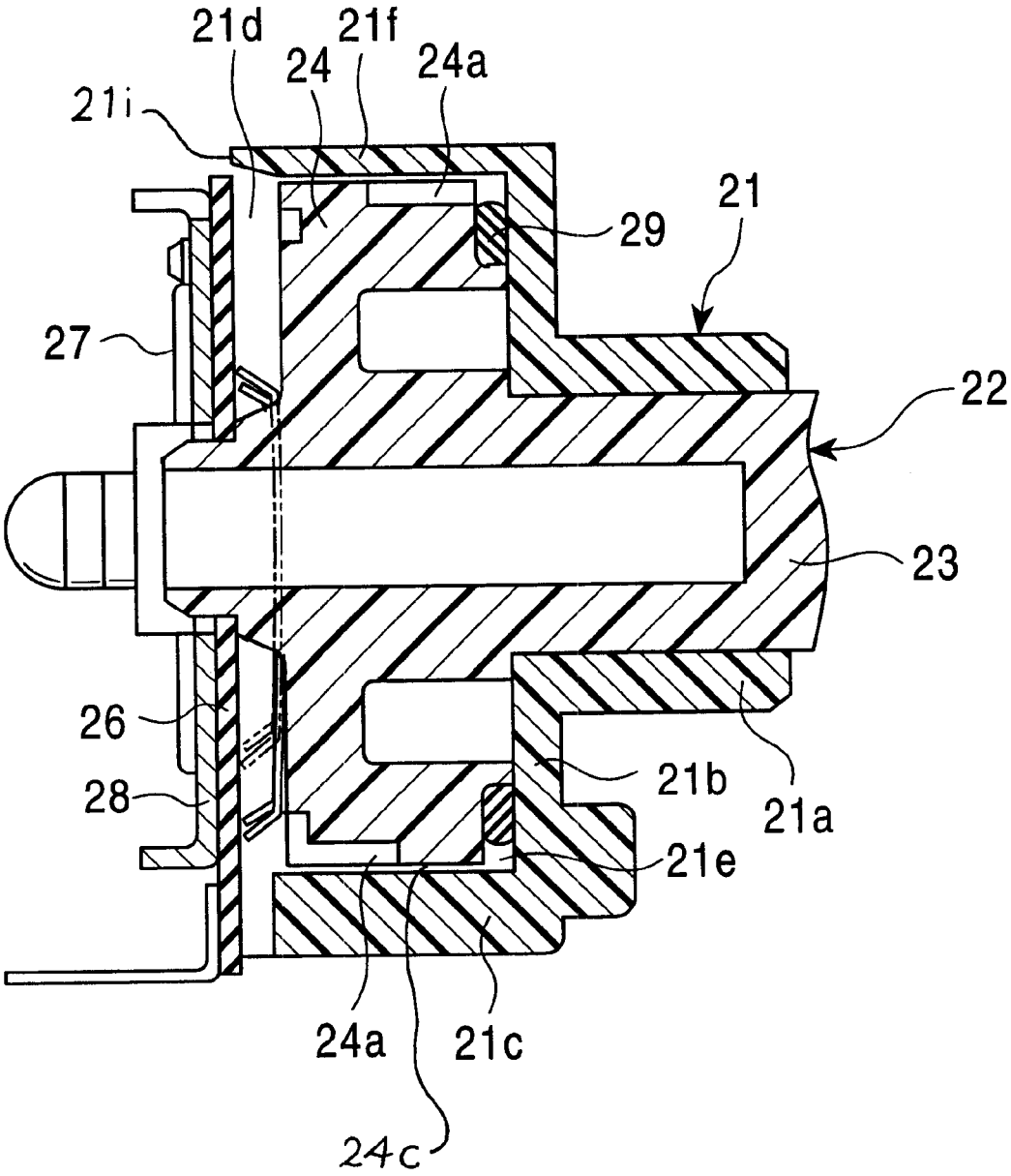
FIG. 9 is a sectional view showing the principal part of a tactile-feedback rotary electrical component according to a second embodiment of the present invention.
Figure 10:
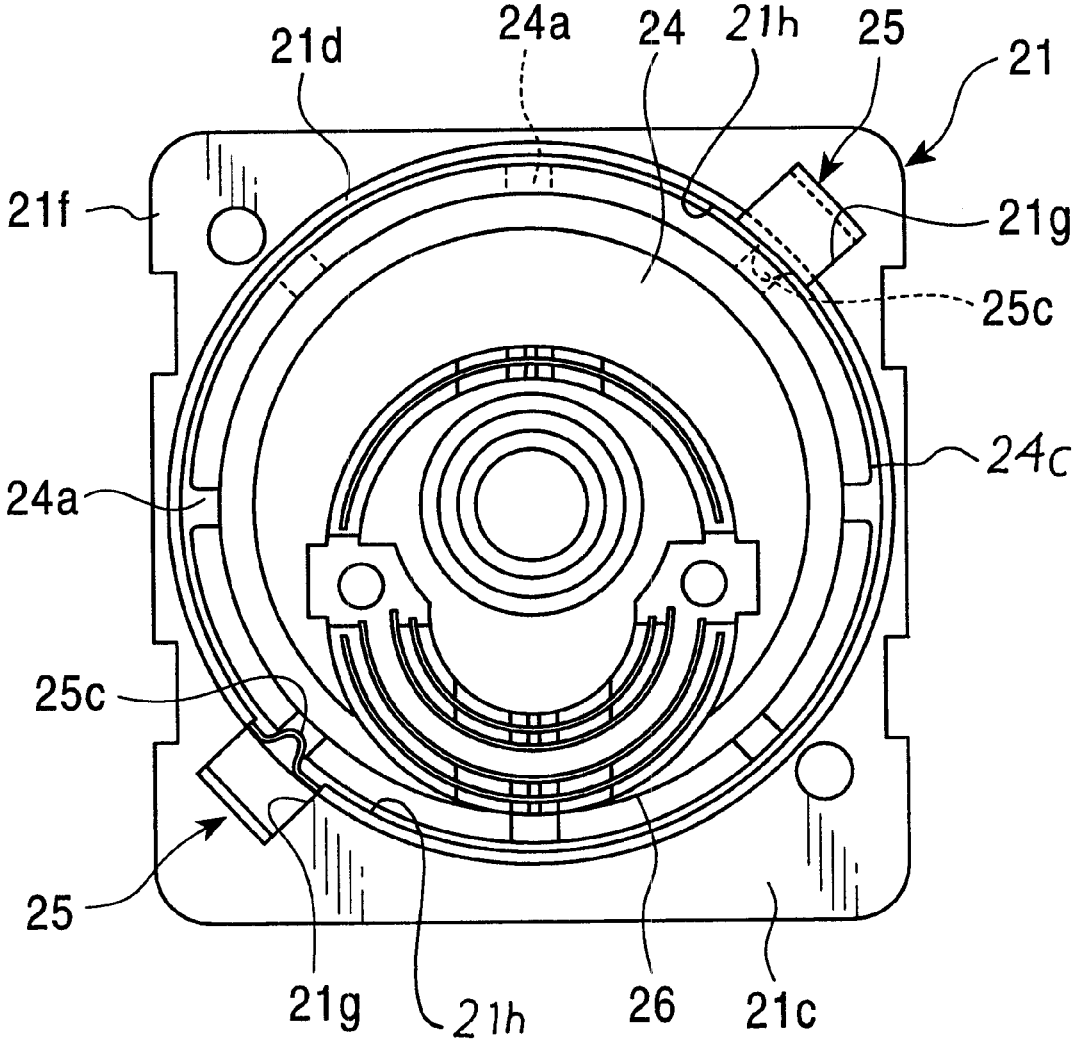
FIG. 10 is a rear view of the tactile-feedback rotary electrical component in which an operating member is mounted in a housing.
Figure 11:
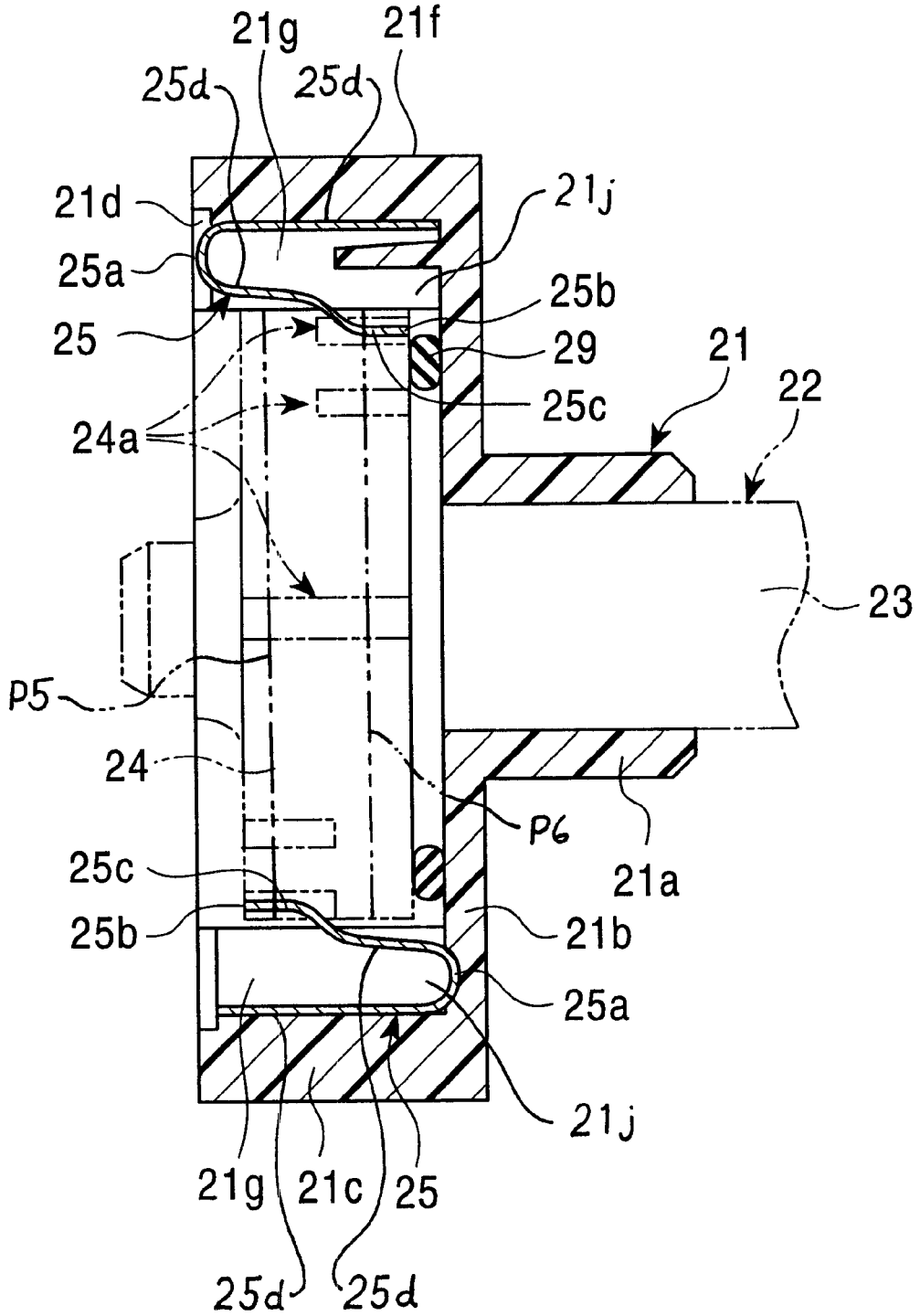
FIG. 11 is a sectional view showing the mounting state of U-shaped springs in the principal part of the tactile-feedback rotary electrical component.
Figure 12:
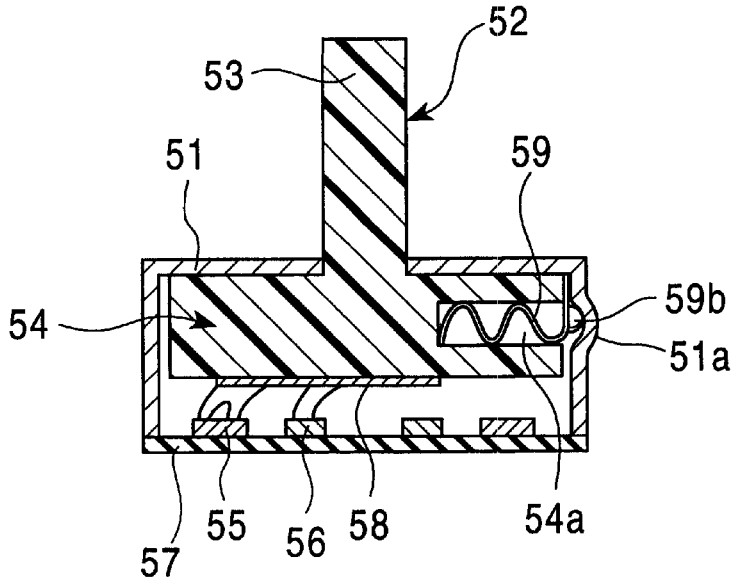
FIG. 12 PRIOR ART
FIG. 12 is a sectional view showing the principal part of a conventional tactile-feedback rotary electrical component.
Figure 13:
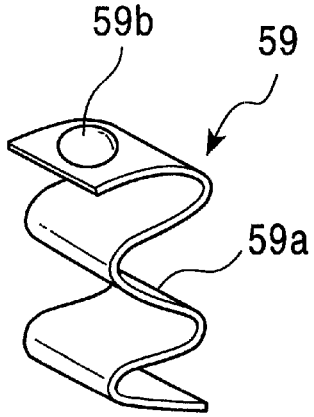
FIG. 13 PRIOR ART
FIG. 13 is a perspective view of a leaf spring in the conventional tactile-feedback rotary electrical component

FIGS. 9 to 11 show a tactile-feedback rotary electrical component according to a second embodiment of the present invention. FIG. 9 is a sectional view showing the principal part of the tactile-feedback rotary electrical component, FIG. 10 is a rear view of the tactile-feedback rotary electrical component in which an operating member is mounted in a housing, and FIG. 11 is a sectional view showing the principal part of the tactile-feedback rotary electrical component in which U-shaped springs are mounted, and in which the outline of an operating member 22 is shown by two-dot chain lines.

In the tactile-feed back rotary electrical component of the second embodiment, a housing 21, which is die-cast in zinc or is molded of synthetic resin, comprises a bearing section 21*a*, a front side plate 21*b*, and a cylindrical wall section 21*c* formed integrally with the bearing section 21*a* via the front side plate 21*b*.

The wall section 21*c* of the housing 21 includes a holder portion 21*e* formed in the center with an open portion 21*d* opened at one end 21*i*, a polygonal (quadrangular) outer wall 21*f*, and a plurality of holding recesses 21*g* formed on the inner wall 21*h* of the wall section 21*c* so as to face the corners of the outer wall 21*f*.

The operating member 22 molded of synthetic resin or the like includes an operating section 23 and a rotating section 24. The rotating section 24 has a plurality of groove-shaped elongated recesses 24*a* formed on the outer peripheral surface 24*c*.

The operating member 22 is rotatably mounted in the housing 21 while the operating section 23 is passed through the bearing section 21*a* and the rotating section 24 is held in the holder portion 21*e*.

When the operating member 22 is mounted in the housing 21, the recesses 24*a* are in parallel with the axial direction of the operating section 23.

Furthermore, when the operating member 22 is mounted, an O-ring 29 for producing a torque is placed between the rotating section 24 and the front side plate 21*b*.

First U-shaped springs 25 formed of a leaf spring each include a connecting portion 25*a*, two free end portions 25*b* connected by the connecting portion 25*a*, and a relatively long rib-shaped protuberance 25*c* formed at one of the free end portions 25*b*.

As shown in FIG. 11, one of the first U-shaped springs 25 is held in the holding recess 21*g* parallel to the axial direction of the operating section and is placed along the axial direction so that the free end portions 25*b* are disposed in the inner part of the holding recess 21*g* and so that the connecting portion 25*a* is disposed on the side of the open portion 21*d*. The protuberance 25*c* thereof engages with and disengages from the recesses 24*a* of the rotating section 24, thereby producing tactile feedback. A sliding path P5 of the protuberance 25*c* of one of the U-shaped springs is shown by a two-dot chain line in FIG. 11.

The other first U-shaped spring 25 is held in the holding recess 21*g* parallel to the axial direction of the operating section 23 and is placed along the axial direction so that the free end portions 25*b* are disposed on the side of the open portion 21*d* and so that the connecting portion 25*a* is disposed in the inner part 21*j* of the holding recess 21*g*. The protuberance 25*c* thereof engages with and disengages from the recesses 24*a* of the rotating section 24, thereby producing tactile feedback. A sliding path P6 of the protuberance 25*c* of the other of the U-shaped springs is shown by a two-dot chain line in FIG. 11.

This makes the sliding paths P5, P6 of the first U-shaped springs 25 different from each other, and thereby increases the service life of the clicking operation.

In order to fit in the U-shaped springs 25, the operating member 22 is mounted in the housing 21 after one of the U-shaped springs 25 with the connecting portion 25*a* pointing toward the open portion 21*d* is put in the holding recess 21*g*, and the other U-shaped spring 25 is mounted.

While the first U-shaped springs 25 of the same shape are mounted in opposite orientations in this embodiment so as to make the sliding paths thereof different, for example, two U-shaped springs having protuberances formed in different positions may be held in the same orientation in the holder portion 21*e*.

Furthermore, one of the first U-shaped springs 25 may be replaced with the same U-shaped spring as the second U-shaped spring 6 in the first embodiment, and the rotating section 24 may be elastically pressed toward the rotating center by the first U-shaped spring 25 and the second U-shaped spring so as to be prevented from run-out.

While the rotating section 24 has the recesses 24*a* and the first U-shaped springs 25 have the protuberances 25*c* in the above description, the rotating section 24 may have protuberances and the first U-shaped springs 25 may have recesses.

A sliding element 26 is mounted on the rotating section 24.

An insulating substrate 27 is provided with resistors (not shown) and conductors (not shown). The insulating substrate 27 is placed to close the open portion 21*d* of the housing 21, and is mounted on the housing 21 via an attachment plate 28 disposed at the rear of the insulating substrate 27, whereby the sliding element 26 is allowed to slide on the resistors and the conductors.

Description will be given below of the operation of the tactile-feedback rotary electrical component according to the second embodiment of the present invention.

First, when the operating member 22 is rotated, the rotating section 24 is also rotated, and the sliding element 26 slides on the resistors and the conductors, thereby adjusting the resistance.

With the rotation of the operating member 22, the recesses 24*a* of the rotating section 24 and the protuberances 25*c* of the first U-shaped springs 25 engage and disengage to perform a clicking operation, whereby tactile feedback is produced.

While the rotary variable resistor is described as an example in the above embodiment, the present invention is, of course, also applicable to other rotary electrical components, such as encoders and rotary switches.

When the tactile-feedback rotary electrical component according to the present invention is assembled, since the first U-shaped spring 5 is held in the recessed holder portion 1*e* of the housing 1, the rotating section 4 may be inserted from the open portion 1*d* after the first U-shaped spring 5 is mounted in the housing 1, or the first U-shaped spring 5 may be fitted after the rotating section 4 is inserted in the housing 1. This makes it possible to provide a tactile-feedback rotary electrical component that is less expensive and that achieves higher assembly efficiency than the conventional rotary electrical component in which the rotating section 54 is fitted with the compressed leaf spring 59.

Since the first U-shaped spring 5 is mounted in the holder section 1*e* of the housing 1 and need not be larger than necessary in expectation of bending of the spring, it can be mounted more firmly than in the conventional rotary electrical component in which the leaf spring 59 is loosely fitted in the hole 54. This can produce a more distinct tactile feedback.

Because of the U-shaped spring 5 for performing a clicking operation, a tactile-feedback rotary electrical component is less expensive and provides higher workability than in the conventional case using a zigzag spring. If the rotating section 4 and the housing 1 are made more compact for the purpose of size reduction, since the housing 1 for holding the first U-shaped spring 5 has a larger capacity than that of the rotating section 4, the first U-shaped spring 5 can be made larger than the conventional leaf spring 59. This makes response to a high torque possible.

Since the rotating section 4 has the recesses 4*a* and the first U-shaped spring 5 has the protuberance 5*c*, it is possible to provide an inexpensive tactile-feedback rotary electrical component having a simple structure.

Even when the operating member 2 moves in the axial direction, the protuberance 5*c* and the recess 4*a* do not disengage due to the structure thereof. Therefore, it is possible to reliably perform a clicking operation and to move the operating member 2 smoothly.

The two first U-shaped springs 25 are mounted in the holding recesses 1*g*, and the sliding paths of the protuberances 5*c* thereof with respect to the rotating section 4 are different from each other. This provides a tactile-feedback rotary electrical component having a long service life.

One of the first U-shaped springs 25 is mounted so that the free end portions 25*b* are disposed on the side of the open portion id and so that the connecting portion 25*a* is disposed in the inner part of the holding recess 1*g*. In contrast, the other U-shaped spring 25 is mounted so that the free end portions 25*b* are disposed in the inner part of the holding recess 21*g* and so that the connecting portion 25*a* is disposed on the side of the open portion 1*d*. The sliding paths of the protuberances 25*c* of the first U-shaped springs 25 with respect to the rotating section 24 are thereby made different from each other. Therefore, a long-service-life clicking operation can be achieved, and it is only necessary to place the first U-shaped springs 25 of the same shape in different orientations. This provides an inexpensive tactile-feedback rotary electrical component with high productivity.

Since the first U-shaped springs 25 are held in the holding recesses 21*g* so as to be placed along the axial direction of the operating section 23, the sliding positions of the protuberances 25*c* on the rotating section 24 are changed by placing the first U-shaped springs 25 so that the connecting portions 25*a* and the free end portions 25*b* are oriented in opposite directions. Therefore, the click position can be changed as necessary by forming recesses in the rotating section 24 with different pitches in the height direction of the rotating section 24. This provides a tactile-feedback rotary electrical component that has versatility in click position.

Since the second U-shaped spring 6 formed of a leaf spring elastically presses the outer peripheral surface of the rotating section 4, the rotation center of the rotating section 4 can coincide with the axis in cooperation with the first U-shaped spring 5, and this can prevent run-out.

The wall section 1*c* of the housing 1 has the polygonal outer wall 1*f*, and the holding recesses 1*g* are formed on the inner wall of the wall section 1*c* facing the corners of the outer wall 1*f*. Therefore, the first and second U-shaped springs 5 and 6 can be fitted in the holding recesses 1*g* with a high space factor, which makes it possible to reliably mount the U-shaped springs 5 and 6 in a compact structure.

At least the first U-shaped spring 5 is held in one of the plural holding recesses 1*g*, the first or second U-shaped spring 5 or 6 is held in the other holding recess 1*g*, and the rotating section 4 is elastically pressed toward the rotation center by the plural U-shaped springs 5 and 6. Therefore, the rotation center of the rotating section 4 can coincide with the axis, and run-out is prevented.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A tactile-feedback rotary electrical component comprising:

a housing having a cylindrical wall section with an open portion opened at a rear end;

an operating section rotatably mounted in said housing;

a rotating section held in said housing to be rotated by said operating section; and a first U-shaped spring formed of a leaf spring, wherein said first U-shaped spring is held in a recessed holder section formed in said wall section of said housing and in an axial direction of said operating section, a portion of said first U-shaped spring has a protuberance facing and in sliding contact with an outer peripheral surface of said rotating section, the outer peripheral surface of said rotating section has a recess fitted to the protuberance, and said protuberance and said recess are engaged and disengaged by rotation of said rotating section to produce tactile feedback, and wherein the recessed holder section has a bottom wall opposing the outer peripheral surface of the rotating section and a pair of side walls arranged at both sides in a rotating direction of the rotating section with respect to the bottom wall, the first U-shaped spring is stored in the recessed holder section such that the first U-shaped spring abuts against the pair of side walls with a position of the first U-shaped spring set with respect to the rotating direction, the first U-shaped spring is always in resilient contact with each of the outer peripheral surface of the rotating section and the bottom wall of the recessed holder section.

2. A tactile-feedback rotary electrical component according to claim 1, wherein said protuberance is shaped like a rib, and said recess is shaped like a groove.

3. A tactile-feedback rotary electrical component according to claim 1, wherein two first U-shaped springs are mounted in said holder section such that the protuberances of the first U-shaped springs contact the rotating section at different positions in the axial direction and sliding paths of said protuberances of said two first U-shaped springs with respect to said rotating section are different from each other.

4. A tactile-feedback rotary electrical component according to claim 3, wherein one of said first U-shaped springs is placed such that a free end portion thereof is disposed on a side of said open portion of said cylindrical wall section in said holder section and such that a connecting portion thereof is disposed in an inner portion of said cylindrical wall section, and the other U-shaped spring is placed such that a connecting portion thereof is disposed on the side of said open portion of said cylindrical wall section in said holder section and such that a free end portion thereof is disposed in said inner portion of said cylindrical wall section.

5. A tactile-feedback rotary electrical component according to claim 1, further comprising: a second U-shaped spring formed of a leaf spring to elastically press the outer peripheral surface of said rotating section.

6. A tactile-feedback rotary electrical component according to claim 5, wherein at least said first U-shaped spring is held in one of plural holder sections, one of said first and second U-shaped spring is held in another holder section, and said rotating section is elastically pressed toward a rotation center by said plural U-shaped springs.

7. A tactile-feedback rotary electrical component according to claim 1, wherein said wall section of said housing has a polygonal outer wall, and said holder section is formed on an inner wall of said wall section facing a corner of said outer wall.

8. A tactile-feedback rotary electrical component comprising:

a housing recessed in cross section and having a cylindrical wall section, a front side plate with a bearing section formed at one end of the wall section, and a recessed section defined by the wall section and the front side plate;

an operating member having an operating section rotatably mounted in the bearing section of the housing and a rotating section disposed in the recessed section of the housing, the rotating section having an outer peripheral surface opposing the wall section, the outer peripheral surface of the rotating section having a recess formed therein to extend in parallel with a rotation axis of the rotating section;

a first U-shaped spring formed of a leaf spring, and having two pieces and a connecting portion, each piece having one end connected with the other piece by the connecting portion and another end forming a free end, one of the pieces having a protuberance formed thereon; and a substrate mounted at another end of the wall section of the housing to close the recessed section of the housing, wherein a first recessed holder section is formed in the wall section to extend from the another end of the wall section toward the front side plate and connected with the recessed section, the first recessed holder section has a bottom wall opposing the outer peripheral surface of the rotating section and a pair of side walls arranged at both sides in a rotating direction of the rotating section with respect to the bottom wall, the first U-shaped spring is disposed in the first recessed holder section such that the two pieces extend from the connecting portion along the rotational axis of the rotating section and such that the protuberance faces and is in sliding contact with the outer peripheral surface of the rotating section, the first U-shaped spring is stored in the first recessed holder section such that the first U-shaped spring abuts against the pair of side walls with a position of the first U-shaped spring set with respect to the rotating direction, the first U-shaped spring is always in resilient contact with each of the outer peripheral surface of the rotating section and the bottom wall of the first recessed holder section, the protuberance of the first U-shaped spring fits in the recess in the outer peripheral surface of the rotating section, and the two pieces of the first U-shaped spring are disposed in elastic contact with the rotating section and the housing, and the recess in the outer peripheral surface of the rotating section and the protuberance of the first U-shaped spring are alternately engaged and disengaged by rotation of the rotating section to produce tactile feedback.

9. A tactile-feedback rotary electrical component according to claim 8, wherein the connecting portion of the first U-shaped spring is disposed more proximate to the substrate and the free ends of the first U-shaped spring are more proximate to the front side plate.

10. A tactile-feedback rotary electrical component according to claim 8, wherein the connecting portion of the first U-shaped spring is disposed more proximate to the front side plate and the free ends of the first U-shaped spring are more proximate to the substrate.

11. A tactile-feedback rotary electrical component according to claim 8, wherein another first U-shaped spring is disposed in a second recessed holder section formed at a different position in the wall section, one of the first U-shaped springs having the connecting portion disposed more proximate to the front side plate and the free ends more proximate to the substrate and the other of the first U-shaped springs having the connecting portion disposed more proximate to the substrate and the free ends more proximate to the front side plate, and relative contact positions along the rotation axis at which the protuberances of the first U-shaped springs contact the rotating section are different from each other.

12. A tactile-feedback rotary electrical component according to claim 8, further comprising:

a second U-shaped spring formed of a leaf spring, the first and second U-shaped springs being differentiated substantially in that the protuberance is formed on only the first U-shaped spring; and a second recessed holder section formed in the housing to hold the second U-shaped spring, wherein the first recessed holder section and the second recessed holder section are disposed opposite to each other with the rotation axis therebetween, and the rotating section is elastically pressed toward the rotation axis by the first and second U-shaped spring.

13. A tactile-feedback rotary electrical component comprising:

a housing having a cylindrical wall section with an open portion opened at a rear end;

an operating section rotatably mounted in said housing;

a rotating section held in said housing to be rotated by said operating section; and a first U-shaped spring formed of a leaf spring, wherein said first U-shaped spring is held in a recessed holder section formed in said wall section of said housing and in an axial direction of said operating section, a portion of said first U-shaped spring has a recess facing an outer peripheral surface of said rotating section, the outer peripheral surface of said rotating section has a protuberance fitted to the recess, and said protuberance and said recess are engaged and disengaged by rotation of said rotating section to produce tactile feedback, and wherein the recessed holder section has a bottom wall opposing the outer peripheral surface of the rotating section and a pair of side walls arranged at both sides in a rotating direction of the rotating section with respect to the bottom wall, the first U-shaped spring is stored in the recessed holder section such that the first U-shaped spring abuts against the pair of side walls with a position of the first U-shaped spring set with respect to the rotating direction, the first U-shaped spring is always in resilient contact with each of the outer peripheral surface of the rotating section and the bottom wall of the recessed holder section.

14. A tactile-feedback rotary electrical component according to claim 13, further comprising:

a second U-shaped spring formed of a leaf spring, the first and second U-shaped springs being differentiated substantially in that the recess is formed on only the first U-shaped spring; and a second recessed holder section formed in the housing to hold the second U-shaped spring, wherein the first recessed holder section and the second recessed holder section are disposed opposite to each other with the rotation axis therebetween, and the rotating section is elastically pressed toward the rotation axis by the first and second U-shaped spring.

15. A tactile-feedback rotary electrical component according to claim 13, wherein said wall section of said housing has a polygonal outer wall, and said recessed holder section is formed on an inner wall of said wall section facing a corner of said outer wall.

* * * * *